US006564534B2

(12) United States Patent
Poulton et al.

(10) Patent No.: US 6,564,534 B2
(45) Date of Patent: May 20, 2003

(54) BAG FILLING APPARATUS

(75) Inventors: Barrie Armstrong Poulton, Cheltenham (GB); Adrian David Morris, Sale (GB)

(73) Assignee: Flomat Bagfilla International Limited, Derbyshire (GB)

( * ) Notice: Subject to any disclaimer, the term of this patent is extended or adjusted under 35 U.S.C. 154(b) by 0 days.

(21) Appl. No.: 10/133,553

(22) Filed: Apr. 26, 2002

(65) Prior Publication Data

US 2003/0051446 A1 Mar. 20, 2003

(30) Foreign Application Priority Data

Sep. 19, 2001 (GB) ..... 0122548

(51) Int. Cl.[7] ..... B65B 43/26

(52) U.S. Cl. ..... 53/570; 53/468; 53/469; 53/473; 53/284.7; 141/316; 141/391

(58) Field of Search ..... 53/570, 468, 469, 53/473, 284.7; 383/22, 24; 141/10, 275, 314, 316, 390, 392, 114, 313, 315, 391; 248/954, 97, 99, 95, 100

(56) References Cited

U.S. PATENT DOCUMENTS 4,519,426 A * 5/1985 Hardy, Jr. ..... 141/114
4,872,493 A * 10/1989 Everman ..... 141/114
5,259,425 A * 11/1993 Johnson et al. ..... 100/281
5,348,063 A * 9/1994 Handleman ..... 141/10
5,513,682 A * 5/1996 Derby ..... 141/313
5,787,945 A * 8/1998 Riemersma ..... 141/114
6,065,271 A * 5/2000 Nicastro ..... 53/284.7
6,089,283 A * 7/2000 Sienerth et al. ..... 141/1
6,112,504 A * 9/2000 McGregor et al. ..... 141/10
6,176,278 B1 * 1/2001 Gill et al. ..... 141/114

OTHER PUBLICATIONS

Flomat Bagfilla International 'C' Frame FIBC Filling Machines Brochure, 2 pages—undated.

* cited by examiner

*Primary Examiner*—Rinaldi I. Rada
*Assistant Examiner*—Brian Nash
(74) *Attorney, Agent, or Firm*—Bracewell & Patterson, L.L.P.

(57) ABSTRACT

A bag filling apparatus comprises a filling head, a structure providing suspension points for suspending a bag in registry with the filling head and a rigging arrangement for sealing the bag with the filling head. The rigging arrangement includes a rigging ring for use in locating an inlet of the bag. The support structure and the rigging ring are movable independently of the filling head between a lower position facilitating rigging of the bag loops and the bag inlet to the suspension points and the rigging ring and an upper position in which the bag loops are raised and the rigging ring is registered with the filling head.

10 Claims, 3 Drawing Sheets

BAG FILLING APPARATUS

FIELD OF THE INVENTION

This invention concerns bag filling apparatus and, more particularly, apparatus for handling flexible intermediate bulk carriers (FIBCs, popularly known as big bags).

BACKGROUND OF THE INVENTION

This invention particularly relates to bag filling apparatus of the type comprising a filling head, a structure providing suspension points for suspending a bag in registry with the filling head and a rigging arrangement for sealing the bag with the filling head, the rigging arrangement including a rigging ring for use in locating an inlet of the bag. Such apparatus is herein referred to as "a bag filling machine of the type referred to".

An FIBC comprises a flexible bag which, at its upper inlet end, is provided with four flexible loops of fabric by means of which the bag is suspended from the suspension points of the support structure. The FIBC typically incorporates a liner forming an inlet opening or spout for attachment to the filling head. Usually, during filling, the bag is suspended over a table (optionally a vibratory table) located beneath the filling head for contact with the underside of the bag.

The current practice when filing FIBCs involves the operator rigging the empty FIBC and internal liner to the filling machine prior to filling. This involves locating and securing the four FIBC loops at appropriate suspension points and then feeding the spout of the FIBC liner through the rigging ring and wrapping the liner spout about this ring to secure its position. The liner is then sealed against the filling head by inflating an inflation bladder that is fixed to the lower part of the filling head.

When filling small FIBCs (FIBCs with a seam height of 1200 mm or less), the operator can perform the rigging operation from floor level. However if the FIBC is of a larger size (e.g. 1200 mm or above), then the operator cannot reach high enough to rig the FIBC. This can be overcome by use of a raised platform to enable the operator to reach the filling head and FIBC suspension points. The use of a raised operating platform is undesirable for the following reasons:

- the platform takes up floor space
- the cost of the platform can be expensive
- the rigging of an FIBC from raised platform is unergonomic for the operator An alternative approach is to mount the the filling head on the apparatus in such a way that it is raised and lowered along with the bag suspension points. This is not desirable, as it requires the use of a long length of flexible pipe to feed into the filling head with the product to be supplied to the FIBC. Long lengths of pipe are considered to be unhygienic and may have a detrimental effect on the accuracy of the weighing system used to determine the weight of material introduced into the FIBC.

SUMMARY

An objective of the present invention is to facilitate floor-level rigging of a range of FIBC sizes, even larger FIBCs having a seam height of 1200 mm or more.

According to the present invention there is provided a bag filling apparatus of the type referred to in which the support structure and the rigging ring are movable independently of the filling head between a lower position facilitating rigging of the bag loops and the bag inlet to the suspension points and the rigging ring and an upper position in which the bag loops are raised and the rigging ring is registered with the filling head.

The rigging ring may be carried by the support structure.

Movement of the support structure between its lower and upper positions may be effected by a suitable drive such as fluid powered piston and cylinder assembly or assemblies.

The filling head may be mounted for vertical adjustment to accommodate bags of different heights.

Adjustment of the filling head may be effected by means of a drive arrangement such as a rack and pinion drive.

A device, e.g. a clamping device, may be provided for fixing the filling head in a selected position of adjustment.

The drive for raising and lowering the supporting structure may act to effect movement of the supporting structure relative to the filling head. For example, the raising and lowering drive may act between a carriage mounting the filling head for vertical adjustment on a generally vertical mast and the bag-supporting structure so that, when the filling head has been fixed in a selected position of adjustment, the bag-supporting structure can when required be moved relative to filling head to accommodate rigging followed by subsequent raising of the bag for registration with the filling head The filling head may be fitted with an inflatable bladder for co-operation with the rigging ring in order to seal the bag inlet to the filling head, the sealing engagement usually being sufficient to prevent spillage of product and escape of dust.

The invention will now be described further by way of example only with reference to the accompanying drawings, in which:

DETAILED DESCRIPTION OF THE INVENTION

Figure 1:
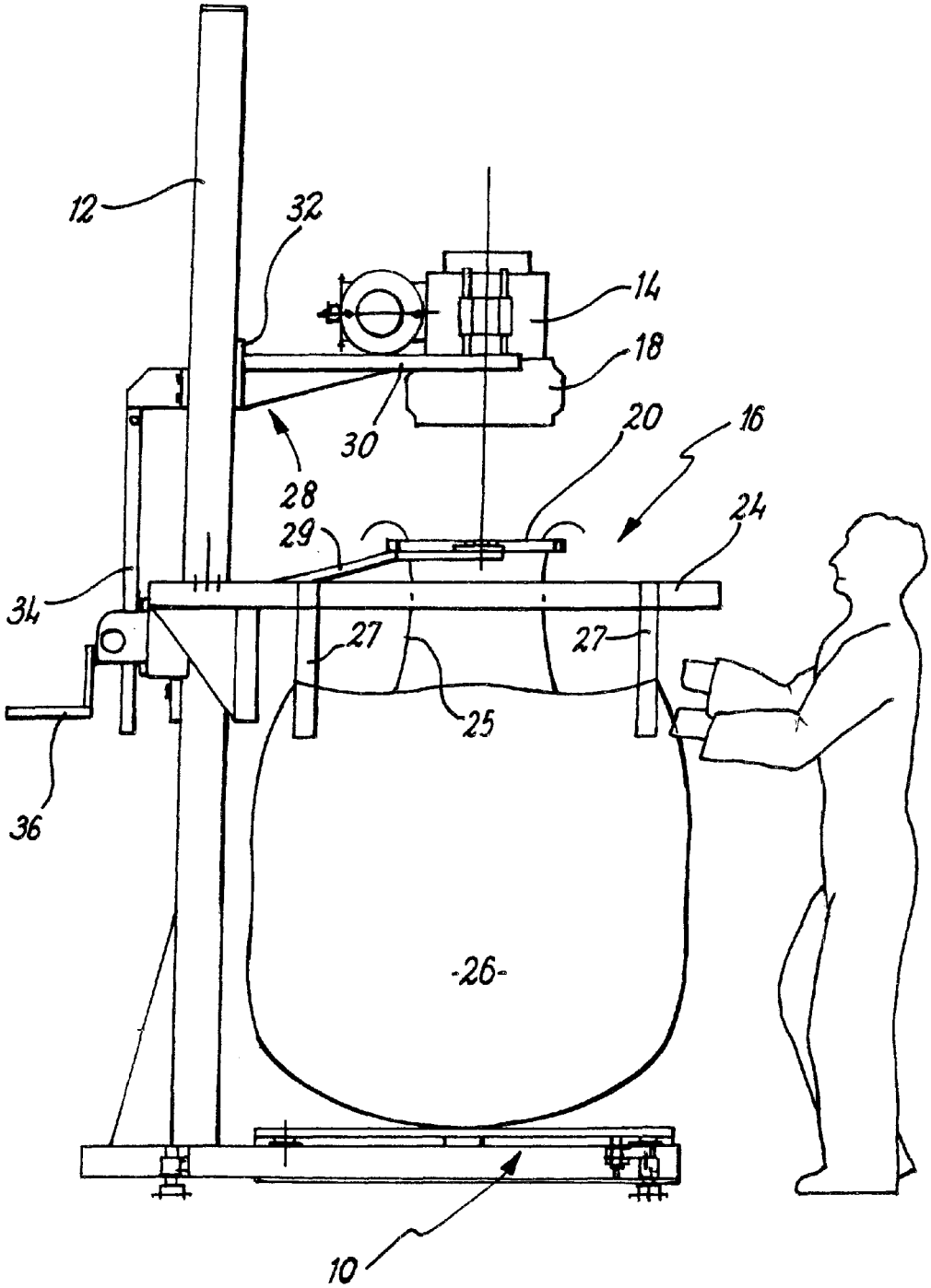
FIG. 1 is a side elevation showing bag filling apparatus of the present invention with the bag support structure and the rigging ring in the lowered position.
Figure 2:
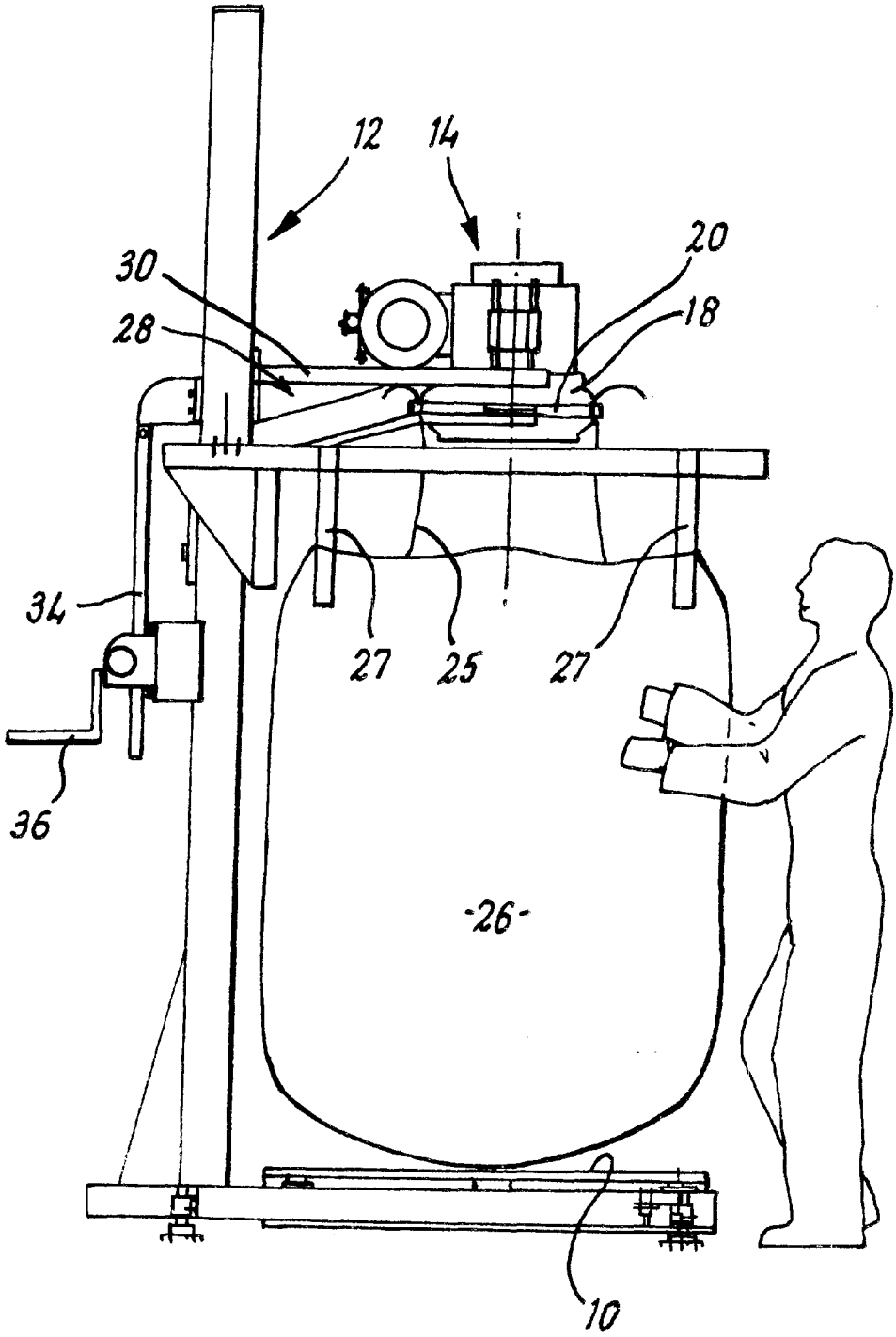
FIG. 2 is a similar view to that of FIG. 1 but showing the bag support structure and the rigging ring in the upper position.
Figure 3:
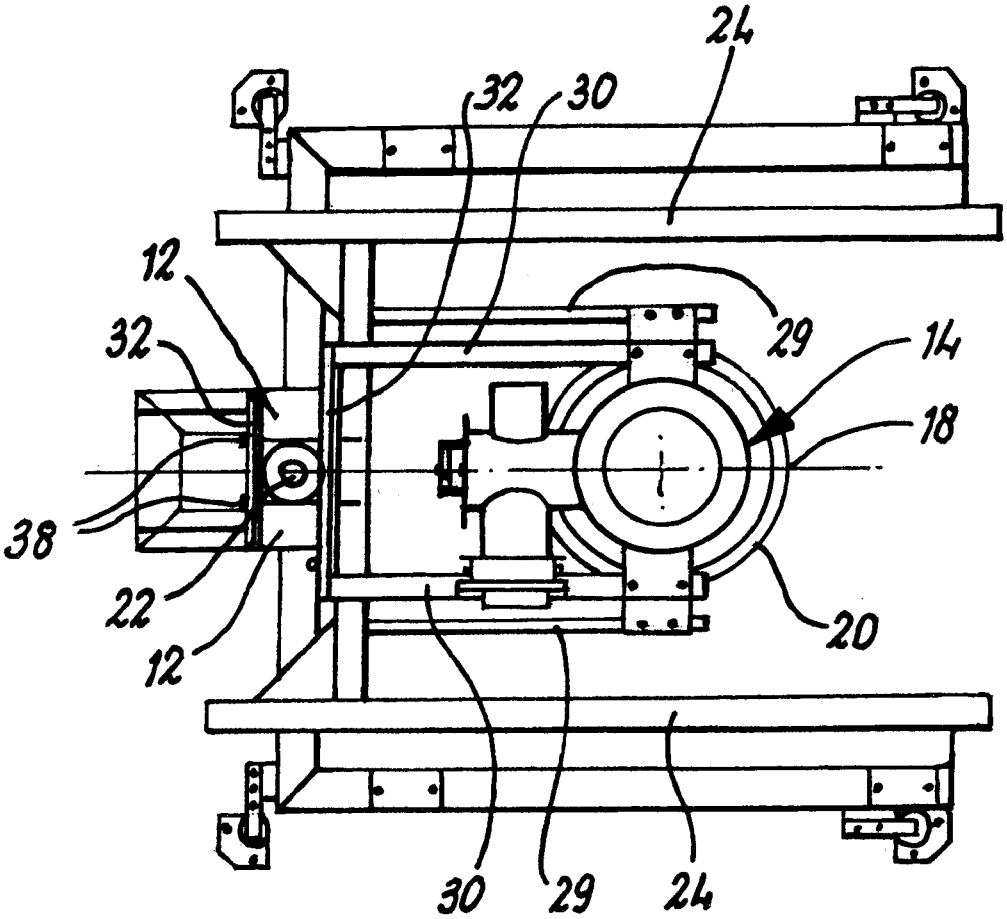
FIG. 3 is a plan view of the apparatus.

Referring now to the drawings, bag filling apparatus in accordance with the invention comprises a table 10 which may be of the vibratory "coned" type if desired, a substantially vertical mast 12, a centrally located filling head 14 mounted on the mast for vertical adjustment and a bag-supporting structure 16 also mounted on the mast for vertical movement independently of the filling head. The apparatus may also incorporate means for weighing the FIBC in the usual way.

The upper end of the filling head is provided with a flexible tube (not shown) for feeding material, e.g. powdered material, to the filling head. At its lower end, the filling head 14 is fitted with an inflatable annular bladder 18 for co-operation with a rigging ring 20. Raising and lowering of the supporting structure 16 is effected under the control of a suitable drive means which in the illustrated embodiment comprises a vertically disposed fluid powered cylinder 22 (e.g. a pneumatic cylinder).

The supporting structure comprises a pair of spaced generally horizontal arms 24 which straddle the central axis of the filling head and provide suspension points for location of the usual four suspension loops 27 of the FIBC 26. The rigging ring 20 is also mounted for vertical movement, conveniently by mounting it on the bag-supporting structure 16 via arms 29. The rigging ring 20 is arranged to encircle the inflatable bladder 18 when raised into overlapping relation with the lower part of the filling head.

The filling head is mounted on the mast for adjustment in the vertical direction and is arranged to be clamped in a selected position of adjustment by a clamping device. To this end, the filling head is supported by a carriage 28 with generally horizontal arms 30 extending from the mast and the clamping device comprises for example a pair of clamping plates 32 which can be drawn together by bolts 38 to fix the filling head in a selected position along the mast 12.

Raising and lowering of the carriage 28 is effected by a drive arrangement comprising a rack 34 and pinion drive operated by handle 36 so that with the clamp released, the filling head can be raised or lowered to the desired vertical position consistent with size of FIBC to be filled. Once the filling head is in the appropriate vertical location, the clamping device is operated to retain it in that position.

The drive means for raising and lowering the supporting structure 16 may act between the structure 16 and the filling head 14 so that, to bring the supporting structure and the rigging ring into the desired operative position relative to the filling head, the extent of movement remains constant irrespective of the vertical location of the filling head. Thus, the piston and cylinder 22 may have one part (the piston for example) coupled to the supporting structure 16 and the other part (e.g. the cylinder) coupled to the carriage associated with the filling head 14. The cylinder may be operated by means of a useroperable control valve (not shown).

In use,with the filling head adjusted to a position suitable for the FIBC to be filled, the operator uses the control valve to extend the pneumatic cylinder 22 and thereby lower the arms 24 and the ring 20 to a height (see FIG. 1) that is comfortable for the operator to rig the FIBC loops to the bag-supporting arms 24 and rig the bag liner 25 to the ring 20. The operator then operates the control valve to retract the pneumatic cylinder 22 and thereby raise the arms 24 and ring 20 up to the filling head bladder 18. Inflation of the bladder 18, e.g. by means of a remote switch, serves to trap the upper region of the liner 25 between the ring and the bladder to effect a seal adequate to prevent dust dispersal and product spillage. The FIBC is then ready to be filled in the usual way.

It will be appreciated that it is not intended to limit the invention to the above example only, many variations, such as might readily occur to one skilled in the art, being possible, without departing from the scope thereof. For instance, the arms 24 may be of adjustable extent and arranged to allow the FIBC loops to move angularly about the axes of the arms, as disclosed in our prior GB Patent Application No. 0119314.3.

What is claimed is:

1. In a bag filling apparatus comprising a filling head, a support structure providing suspension points for suspending a bag having bag loops in registry with the filling head and a rigging arrangement for sealing the bag with the filling head, the rigging arrangement including a rigging ring for use in locating an inlet of the bag, the improvement wherein the support structure and the rigging ring are movable independently of the filling head between a lower position spaced below and separate from the filling head, thereby facilitating rigging of the bag loops and the bag inlet to the suspension points and the rigging ring and an upper position in which the support structure, the bag loops and the rigging ring are raised and the rigging ring is registered with the filling head.

2. Apparatus as claimed in claim 1 in which the rigging ring is carried by the support structure.

3. Apparatus as claimed in claim 1 in which movement of the support structure between its lower and upper positions is effected by a fluid powered piston and cylinder assembly or assemblies.

4. Apparatus as claimed in claim 1 in which the filling head is mounted for vertical adjustment to accommodate bags of different heights.

5. Apparatus as claimed in claim 4 in which adjustment of the filling head is effected by means of a drive arrangement.

6. Apparatus as claimed in claim 4 in which a device is provided for fixing the filling head in a selected position of adjustment.

7. Apparatus as claimed in claim 1 in which the drive for raising and lowering the supporting structure effects movement of the supporting structure relative to the filling head.

8. Apparatus as claimed in claim 7 in which the raising and lowering drive acts between a carriage mounting the filling head for vertical adjustment on a generally vertical mast and the bag-supporting structure so that, when the filling head has been fixed in a selected position of adjustment, the bag-supporting structure can when required be moved relative to filling head to accommodate rigging followed by subsequent raising of the bag for registration with the filling head.

9. Apparatus as claimed in claim 1 in which the filling head is fitted with an inflatable bladder for co-operation with the rigging ring in order to seal the bag inlet to the filling head, the sealing engagement usually being sufficient to prevent spillage of product and escape of dust.

10. A bag filling apparatus, comprising:

a mast;

a filling head mounted to the mast, the filling head having an inflatable bladder;

a support structure carried by the mast, the support structure having suspension points for suspending loops of a bag;

a rigging member for positioning an inlet of the bag, the rigging member being mounted to the support structure and movable in unison with the support structure;

a drive unit for moving the support structure and the rigging member along the mast, while the filling head remains stationary on the mast, between a lower position spaced below and separate from the bladder of the filling head, thereby facilitating rigging of the bag loops and the bag inlet to the suspension points and the rigging member, and an upper position in which the support structure, the bag loops and the rigging member are raised to position the rigging member in engagement with the bladder of the filling head.

* * * * *